US009057113B2

(12) United States Patent
Best et al.

(10) Patent No.: US 9,057,113 B2
(45) Date of Patent: Jun. 16, 2015

(54) FASTENING SYSTEM FOR TILTABLE METALLURGICAL VESSELS

(75) Inventors: Rolf Best, Gladbeck (DE); Martina Berens, Hamminkeln (DE)

(73) Assignee: SMS SIEMAG AKTIENGESELLSCHAFT, Düsseldorf (DE)

( * ) Notice: Subject to any disclaimer, the term of this patent is extended or adjusted under 35 U.S.C. 154(b) by 344 days.

(21) Appl. No.: 13/508,664

(22) PCT Filed: Nov. 24, 2010

(86) PCT No.: PCT/EP2010/068087

§ 371 (c)(1),
(2), (4) Date: May 8, 2012

(87) PCT Pub. No.: WO2011/064233

PCT Pub. Date: Jun. 3, 2011

(65) Prior Publication Data

US 2012/0223107 A1 Sep. 6, 2012

(30) Foreign Application Priority Data

Nov. 28, 2009 (DE) ..... 10 2009 056 219

(51) Int. Cl.

| | |
|---|---|
| ***B22D 41/04*** | (2006.01) |
| ***C21C 5/46*** | (2006.01) |
| ***F27B 3/06*** | (2006.01) |
| ***F27B 3/10*** | (2006.01) |

(52) U.S. Cl.

CPC ..... *C21C 5/4633* (2013.01); *F27B 3/065* (2013.01); *F27B 3/10* (2013.01)

(58) Field of Classification Search

CPC ..... C21C 5/46; C21C 5/42; C21C 5/4633; C21C 5/464; F27B 3/06; F27B 3/10; F27B 3/065; B22D 41/04; B22D 41/06

USPC ..... 266/244–247, 243, 275, 276; 222/604

See application file for complete search history.

(56) References Cited

U.S. PATENT DOCUMENTS

| | | | | |
|---|---|---|---|---|
| 4,266,758 | A * | 5/1981 | Schmitz | 266/244 |
| 6,290,901 | B1 * | 9/2001 | Laubach | 266/246 |

(Continued)

FOREIGN PATENT DOCUMENTS

| | | |
|---|---|---|
| DE | 1903685 B1 | 2/1971 |
| DE | 1603685 | 3/1971 |
| EP | 1061138 A2 | 12/2000 |
| EP | 1061138 B1 | 1/2005 |

(Continued)

OTHER PUBLICATIONS

Schmidt R: Stahl Und Eisen, Verlag Stahleisen, Dusseldorf, DE, Bd. 118, Nr. 8, Aug. 17, 1998.

*Primary Examiner* — George Wyszomierski
*Assistant Examiner* — Michael Aboagye
(74) *Attorney, Agent, or Firm* — Lucas & Mercanti, LLP; Klaus P. Stoffel

(57) ABSTRACT

The invention relates to a fastening system for tiltable metallurgical processing vessels, in particular converters, the processing vessel (1) being mounted in a carrier ring (2) connected to the jacket of the processing vessel by means of plate fin elements (11), each plate fin element consisting of a plate fin connected to the carrier ring (2) by means of a sheet metal connector (16) and a first fastening bracket (14) and connected to the jacket of the processing vessel by means of a further sheet metal connector (17) and a second fastening bracket (15). According to the invention, the sheet metal connector (16, 17) is clamped by a wedge (20) between the flanges (18, 18*a* and 19, 19*a*, respectively) of the fastening bracket (14 and 15, respectively) with zero clearance, said bracket in turn abutting a tab (22) welded to the flanges of the fastening bracket and bridging same. The wedge (20) is actively connected to the tab (22) by means of a bolted connection (21).

3 Claims, 3 Drawing Sheets

(56) References Cited

U.S. PATENT DOCUMENTS

| | | | | |
|---|---|---|---|---|
| 7,662,336 | B2 | 2/2010 | Schubert et al. | |
| 7,871,560 | B2 * | 1/2011 | Best et al. | 266/245 |

FOREIGN PATENT DOCUMENTS

| | | |
|---|---|---|
| RU | 2325446 | 5/2008 |
| WO | 2008092488 | 8/2008 |

* cited by examiner

FASTENING SYSTEM FOR TILTABLE METALLURGICAL VESSELS

TITLE OF THE INVENTION

The present application is a 371 of International application PCT/EP2010/068087, filed Nov. 24, 2010, which claims priority of DE 10 2009 056 219.2, filed Nov. 28, 2009, the priority of these applications is hereby claimed and these applications are incorporated herein by reference.

BACKGROUND OF THE INVENTION

The invention relates to a fastening system for tiltable metallurgical treatment vessels, particularly converters, wherein the treatment vessel is supported in a support ring which is connected through plate-like elements to the treatment vessel casing, wherein each element consists of a plate which is connected to the support ring through an end plate and a first fastening bracket, and which is connected to the treatment vessel casing through another end plate and a second fastening bracket.

Converters are rotatable metallurgical reaction vessels for refining the liquid pig iron. Because of the high temperatures, thermal expansion causes problems in the mounting of the treatment vessel.

In order to be able to compensate for the thermal expansion and to still be able to ensure a seat without play of the converter in its support ring, DE 19 03 685 proposes a fastening system with support strips between support ring and converter casing. In this connection, the support strips have the purpose of facilitating relative movement of converter and support ring.

EP 1 061 138 B1 also discloses a vessel suspension for a converter, wherein the upper chord and the lower chord are connected to each other through releasable, frictionally engaging and positively engaging tension element connections.

When using such converters with this type of vessel fastening, there is the disadvantage that during cleaning operations, such as, for example, removing caked-on slag, the safety plates, which serve for fixing the plate-like element receiving plate in the area of the lateral bracket plates, are loosened or are even torn off. If the safety plates are damaged, it is necessary to repair or replace them. This leads to increases in the costs of the necessary repairs.

SUMMARY OF THE INVENTION

Therefore, it is the object of the present invention to improve the known vessel fastenings and, thus, to avoid the aforementioned disadvantage.

In accordance with the invention, this object is met by a fastening system for tiltable metallurgical treatment vessels, particularly converters, wherein the treatment vessel is supported in a support ring which is connected to the treatment vessel casing through plate-like elements, wherein each element is composed of a thin plate which is connected to the support ring through an end plate and a first fastening bracket and which is connected to the treatment vessel casing through another end plate and a second fastening bracket, wherein the end plate is clamped by means of a wedge without play between the cheeks of the fastening bracket, wherein the wedge, in turn, rests against a lug which is welded to the cheeks of the fastening bracket so as to span over the fastening bracket, and wherein the wedge is operatively connected to the lug through a screw connection.

The screw connection includes a threaded piece for fixing the wedge without play.

The threaded piece is preferably secured by a welded seam after the wedge has been adjusted.

Consequently, in the fastening system according to the invention, the threaded piece and the lug are secured so as to prevent loss thereof. As a result, the fastening system no longer has any loose or releasable components. When mounting the plate-like elements on the support ring or the converter vessel, the individual parts can be assembled without play and are connected to each other undetachably.

DETAILED DESCRIPTION OF THE INVENTION

Figure 3:
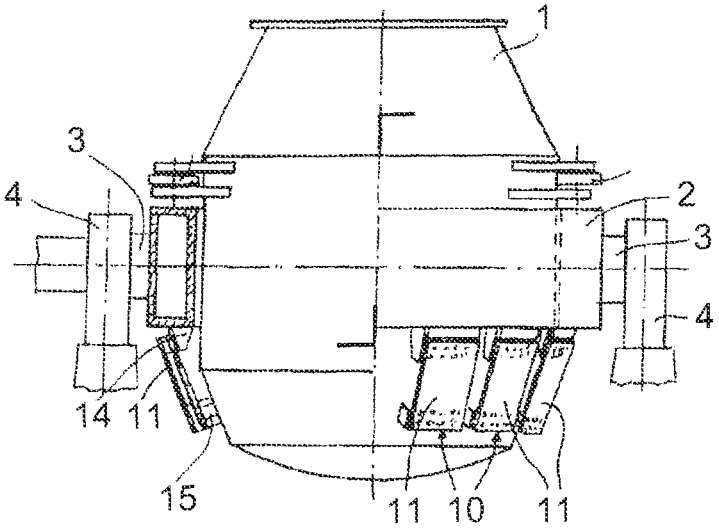
FIG. 3 schematically shows the arrangement of such a fastening system on a converter.

Initially, reference will be made to FIG. 3 which shows a metallurgical treatment vessel, in the form of a conventional converter. This converter is denoted by reference numeral 1.

In order to facilitate tilting of the converter, the converter is arranged in a support ring 2 which is supported through pins 3 in the drive system 4.

The connection between the support ring 2 and the treatment vessel casing is achieved through the fastening system 10 consisting of plate-like elements 11.

The invention is directed to the configuration of this fastening system.

Figure 1:
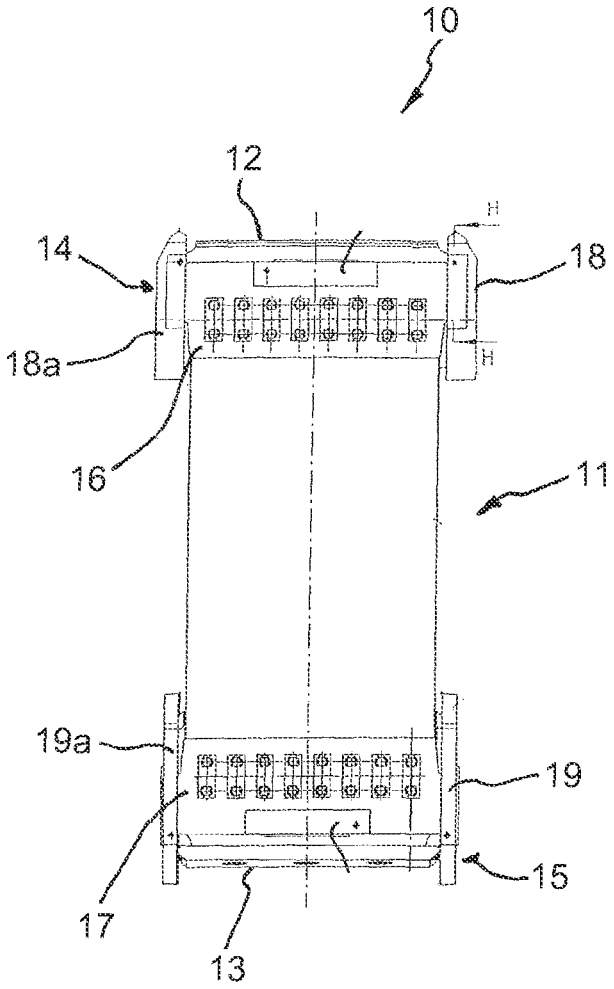
FIG. 1 is a side view of the fastening system according to the invention.

As illustrated in FIG. 1, the fastening system 10 is composed of plate-like elements, wherein one of these is illustrated as an example in FIG. 1.

The plate-like element 11 is in the mounted position with its upper free end 12 and its lower free end 13 connected to a fastening bracket 14, which is the upper bracket in the mounted position, and a fastening bracket 15, which is the lower bracket in the mounted position. The upper free end 12 and the lower free end 13 are connected to end plates 16 and 17. The end plates 16 and 17 are fitted without play in the lateral cheeks 18, 18*a* and 19, 19*a* of the fastening brackets 14 and 15.

Figure 2:
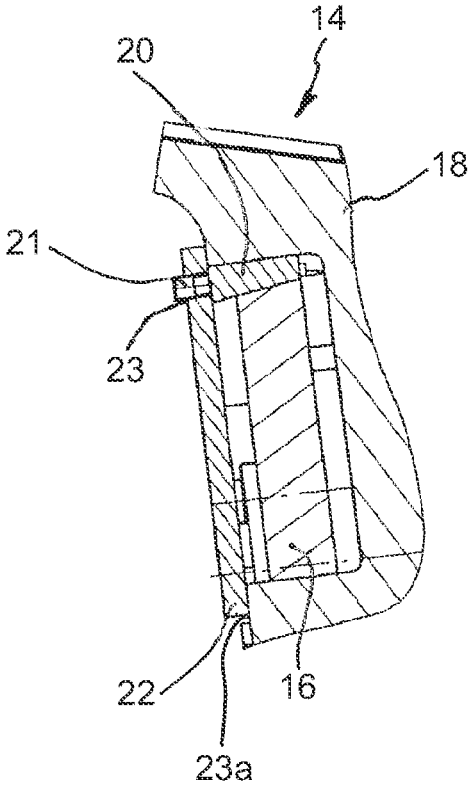
FIG. 2 is a sectional view along line H-H in FIG. 1.

FIG. 2 is a sectional view through the upper fastening bracket 14 along the line H-H. The end plate 16 is clamped and fixed by means of a wedge 20 in the cheek 18. The wedge 20 is held in a fixed position by means of a threaded piece 21, or can be initially positioned by the threaded piece.

The threaded piece 21 is constructed in this embodiment as a stud bolt. To be able to secure the wedge 20 and the end plate 16, a lug 22 extending over the cheeks is provided, wherein the lug is welded to the cheeks.

A welded seam 23 is provided on the threaded piece and the lug 22 as an additional connection.

LIST OF REFERENCE NUMERALS

1 Converter
2 Support ring
3 Pin
4 Drive
10 Fastening system
11 Plate-like element
12 Upper end

13 Lower end
14 Upper fastening bracket
15 Lower fastening bracket
16 End plate
17 End plate
18, 18*a* Cheeks
19, 19*a* Cheeks
20 Wedge
21 Threaded piece
22 Lug
23, 23*a* Welded seam

The invention claimed is:

1. A fastening system for tiltable metallurgical treatment vessels, wherein the treatment vessel is supported in a support ring which is connected through small plate-like elements to a casing at the treatment vessel, wherein each element is composed of a small plate connected through a first end plate and a first fastening bracket to the support ring, and through a second end plate and a second fastening bracket to the treatment vessel casing, wherein each end plate is clamped without play between cheeks of an associated one of the fastening brackets by a wedge arranged between the end plate and one of the cheeks of the associated fastening bracket, the wedge resting against a lug welded to the cheeks of the associated fastening bracket so as to span over the associated fastening bracket and so as to be parallel to the end plate, the wedge being operatively connected to the lug by a screw connection.

2. The fastening system according to claim 1, wherein the screw connection is fixable without play by the wedge.

3. The fastening system according to claim 2, wherein the screw connection includes a threaded piece secured by a welded seam after adjustment of the wedge.

* * * * *